US005467578A

United States Patent [19]

Jensen

[11] Patent Number: 5,467,578

[45] **Date of Patent: *Nov. 21, 1995**

[54] METHOD FOR ENCAPSULATING ARTICLES IN WICKETED BAGS

[75] Inventor: Harold A. Jensen, Brockton, Mass.

[73] Assignee: MHB Industries Corp., Somerville, Mass.

[ * ] Notice: The term of this patent shall not extend beyond the expiration date of Pat. No. 5,249,409.

[21] Appl. No.: 342,659

[22] Filed: Nov. 21, 1994

Related U.S. Application Data

[60] Continuation of Ser. No. 132,501, Oct. 5, 1993, abandoned, which is a division of Ser. No. 892,203, Jun. 2, 1992, Pat. No. 5,249,409.

[51] Int. Cl.[6] ..... B65B 43/26

[52] U.S. Cl. ..... 53/469; 53/284.7; 53/459; 53/468; 53/572

[58] Field of Search ..... 493/204; 53/249, 53/253, 260, 284.7, 384.1, 385.1, 386.1, 459, 468, 469, 474, 492, 571, 572

[56] References Cited

U.S. PATENT DOCUMENTS

| | | | |
|---|---|---|---|
| Re. 32,963 | 6/1989 | Lerner et al. . | |
| 2,964,892 | 12/1960 | Grosjean . | |
| 3,126,094 | 3/1964 | Arnold et al. | 206/554 |
| 3,254,468 | 6/1966 | Lerner | 383/37 X |
| 3,254,828 | 6/1966 | Lerner | 383/37 |
| 3,372,797 | 3/1968 | Grevich | 383/37 X |
| 3,417,864 | 12/1968 | Paxton | 206/554 X |
| 3,640,450 | 2/1972 | Lieberman | 206/554 X |
| 3,680,768 | 8/1972 | Warren . | |
| 3,771,645 | 11/1973 | Wendel | 206/554 X |
| 3,789,570 | 2/1974 | Mullins, Jr. . | |
| 3,807,122 | 4/1974 | Kihnke et al. . | |
| 3,822,527 | 7/1974 | Germunson et al. . | |
| 3,868,807 | 3/1975 | Noyes et al. . | |
| 3,945,173 | 3/1976 | Buzzi . | |
| 3,965,654 | 6/1976 | Reubens et al. . | |
| 3,998,135 | 12/1976 | Sargent . | |
| 4,124,966 | 11/1978 | Wilson . | |
| 4,253,292 | 3/1981 | Lipes . | |
| 4,417,669 | 11/1983 | Knowles et al. | 206/554 X |
| 4,458,466 | 7/1984 | Carbone | 206/554 X |
| 4,519,504 | 5/1985 | Nausedas | 206/554 |
| 4,526,639 | 7/1985 | Reimann | 206/554 X |
| 4,541,226 | 9/1985 | Nausedas . | |
| 4,543,768 | 10/1985 | Nishikawa et al. . | |
| 4,557,384 | 12/1985 | Membrino | 206/554 |
| 4,715,167 | 12/1987 | Savigny . | |
| 4,769,126 | 9/1988 | Roen et al. | 206/554 |
| 4,798,042 | 1/1989 | Davis . | |
| 4,805,381 | 2/1989 | Hannon . | |
| 4,923,064 | 5/1990 | Hannon | 206/554 |
| 4,945,713 | 8/1990 | Widenback . | |
| 4,981,216 | 1/1991 | Wilfong, Jr. | 383/37 X |
| 4,989,391 | 2/1991 | Wetter . | |
| 5,100,000 | 3/1992 | Huseman | 206/554 |
| 5,248,040 | 9/1993 | DeMatteis et al. | 383/37 X |
| 5,249,409 | 10/1993 | Jensen . | |
| 5,363,966 | 11/1994 | Czech et al. . | |

FOREIGN PATENT DOCUMENTS

| | | | |
|---|---|---|---|
| 2659295 | 9/1991 | France | 383/37 |
| 2003443 | 3/1979 | United Kingdom . | |

*Primary Examiner*—John Sipos
*Assistant Examiner*—Daniel Moon
*Attorney, Agent, or Firm*—Samuels, Gauthier & Stevens

[57] ABSTRACT

A wicket of bags such that the bags are releasably secured to a header by release lines. Each bag has a front and back side, side edges, a bottom edge and inner and outer surfaces. The outer surface of the back side of a first bag is adjacent to the outer surface of the front side of the next succeeding bag. A sealed pocket is formed on the outer surface of the front side of a bag and is adapted to have an article encapsulated therein.

2 Claims, 5 Drawing Sheets

METHOD FOR ENCAPSULATING ARTICLES IN WICKETED BAGS

This is a continuation of application Ser. No. 08/132,501 filed on Oct. 5, 1993, now abandoned, which was a divisional of Ser. No. 07/892,203 filed on Jun. 2, 1992, now U.S. Pat. No. 5,249,409.

In my co-pending application, Ser. No. 869,533 filed 15 Apr. 1992, a system is disclosed for encapsulating three-dimensional (as defined in that disclosure) articles on one side of a bag, which bag is formed on a bag making machine. In that disclosure, the drawrollers of a conventional bag making machine are modified to accommodate the three-dimensional article. Also, a feeding mechanism is disclosed whereby the three-dimensional article may be fed to a fold formed in one side of the bag. The fold is subsequently sealed to the bag stock and the bag is formed. Successive bags are assembled to form a wicket.

The system of my prior disclosure was effective for the purposes stated therein, particularly for smaller sized three-dimensional articles, such as packages of cough drops, cigarette packages, packages of gum and the like. However, when it was desired to encapsulate fairly large three-dimensional articles on the side of the bag, more extensive design modifications were required to the prior art bag making machines. These larger articles, such as soap samples, cereal samples, range greatly in length, width and height and modifications to the chute size, feeding arms and drawrollers would result in substantial modifications. That is, if there were a first run where articles, say cigarette packages, were to be encapsulated and then a second run where say cereal boxes were to be encapsulated, extensive changes would have to be made to the system in order to accommodate the various size differences.

In a wicket of bags there is typically a header to which the bags are joined by a release line(s). The header simply comprises the tops of the originally formed bags block welded or sealed one to the other along the upper edges of the bags. In this invention, in the preferred embodiment, the pockets of bags are individually filled and sealed without separating the bags from the wicket (header). Although the preferred embodiment is described in reference to filling and sealing a pocket, the invention broadly embodies just filling the pocket, filling a bag, filling and sealing a bag and in its broadest sense is an apparatus and method for sequentially reversing and exposing, in seritium, one side of a bag in a wicket of bags whereby the bag is positioned for a subsequent step. This subsequent step can include opening a pocket or a bag, filling a pocket or a bag, sealing a pocket or a bag, printing one or both sides of the bag or any combination of the foregoing without removing the bag from the wicket.

In the preferred embodiment, three-dimensional articles are encapsulated into a pocket of a bag(s) in a wicket of bags. The articles are inserted subsequent to bag formation. The system of the invention is easily adaptable to accommodate various size articles to be inserted into the bags.

Wickets of bags are formed in a conventional manner wherein a pocket is formed on the 'front' side of the bag. The pocket is simply a flap which is sealed along its sides and bottom to the bag. Wickets are placed front side down, say 50 bags per wicket, on a platform. The platform moves the bags to a positioning station. At the positioning station, the 'back' side of the bag is engaged and drawn forward over the top of the wicket such that the front side of the bag faces upwardly and lays flat at a feeding station. The bag is released such that it lies front side up while still attached to the wicket. The bag is supported on a retractable plate at the feeding station. A jet of air engages the bag as it travels to ensure the bag lays flat on the plate.

A feeding assembly which comprises a moveable chute and a gate moves into alignment with the bag. A jet of air billows the pocket of the bag and the gate is retracted allowing an article to travel down the chute into the pocket. The air ceases, the chute retracts and the pocket settles down. A sealing bar then engages the free end of the pocket and seals the same to the side of the bag encapsulating the article therein. The sealing bar retracts, the plate pivots downwardly and a jet of air contacts the top surface of the bag causing the bag to fall downwardly while still attached to the wicket. This sequence of steps is repeated until the bags of the wicket have had articles encapsulated therein.

If the article size changes, when the bags are made in the conventional manner the pockets are made larger or smaller as required. The chute size and the position and extension of the sealing arm are adjusted accordingly.

The method of the invention for encapsulating an article on includes transferring the top most bag of the wicket from a support to a feeding station without separating the transferred bag from the wicket, billowing the pocket, inserting the article into the pocket, sealing the free edge to encapsulate the three-dimensional article in the pocket, and removing the bag from the loading station without separating the bag from the wicket.

DESCRIPTION OF THE PREFERRED EMBODIMENT(S)

Figure 1:
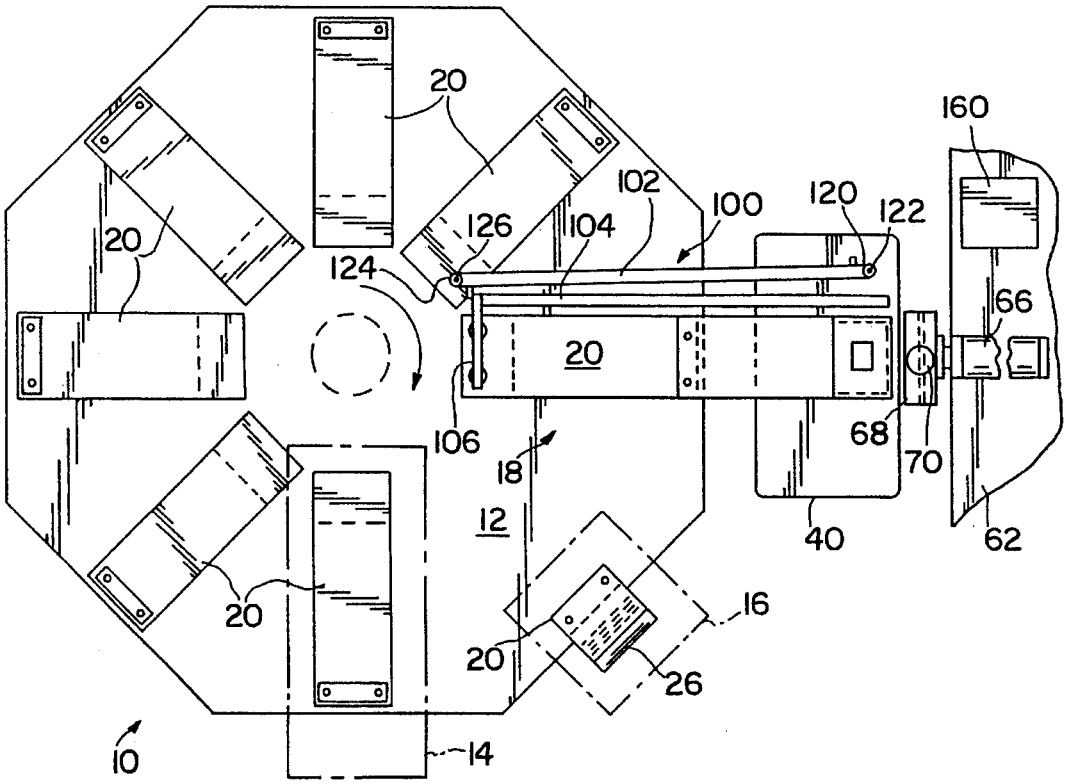
FIG. 1 is a plan view of a system embodying the invention.

Referring to FIG. 1, the system is shown generally at 10 and comprises a carousel platform 12 having eight positions comprising a loading station 14, unloading station 16 and an acquisition station 18. A carriage assembly is shown generally at 100 and comprises a continuously driven belt 102, a track 104 in which a vacuum acquisition arm 106 is carried. The belt 102 and track 104 are non-parallel.

Figure 2:
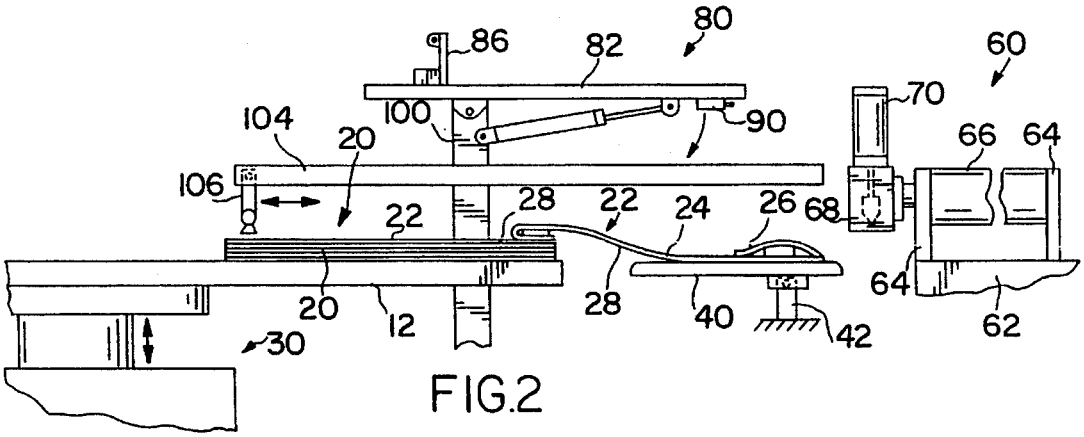
FIG. 2 is a side illustration of FIG. 1.

As shown in FIG. 2, a wicket of bags 20 is at the acquisition station 18. A pivotal support plate is shown generally at 40. A sealing assembly is shown generally at 60. A control module is shown at 160 (FIG. 1). The sealing assembly 60 and the control module 160 are supported by support plate 62 and the plate 40 is supported by a pair of support posts 42. A chute assembly 80 (not shown in FIG. 1) is shown in FIGS. 2–9.

The platform 12 is supported by a pneumatic piston assembly 30 which rotates the platform 12 in timed sequence to move the wickets into position at the acquisition station 18 and to index the wickets upwardly so that the back side of the top most bag may engage the vacuum arm 106. The structure and controls to effect this movement are well within the scope of the art. Other structures to index the wickets upwardly would include a plate underlying the wicket and secured to the platform. The plate could be secured to a post(s) and ratcheted upwardly by a stepping motor or the like.

A wicket 20 is shown laying on the platform 12. Each bag 22 has a front side 24 with a pocket 26 formed thereon and a back side 28.

The sealing assembly 60 includes pillow blocks 64 which support a pneumatic ram 66 which extends and retracts a sealing bar 68 (shown in its retracted position) between its retracted and extended position. The sealing bar 68 is driven by a pneumatic piston 70.

Figure 3:
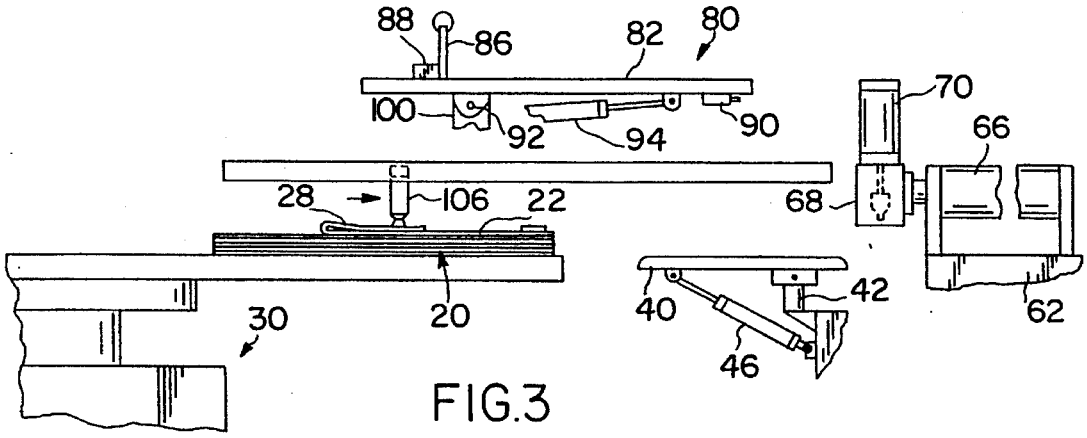
FIG. 3 is a side illustration of an acquisition step in the process of the invention.
Figure 9:
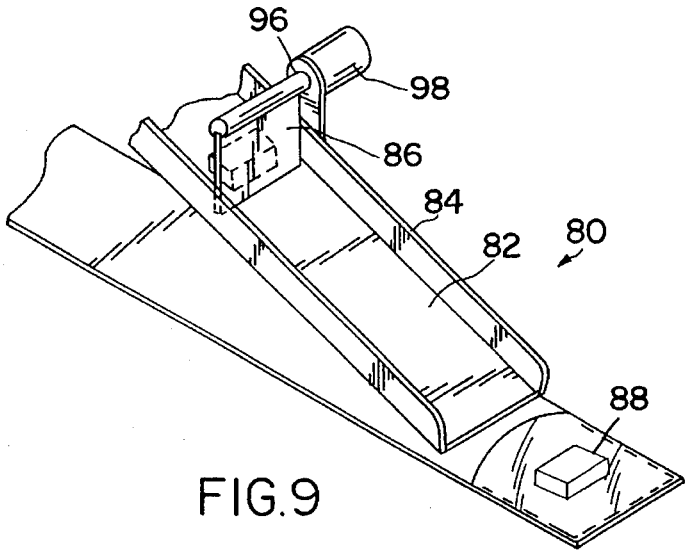
FIG. 9 is a perspective view of a chute assembly.

Referring to FIGS. 3 and 9, the chute assembly 80 comprises a chute 82 having side walls 84, a gate 86, an article 88 to be inserted into the pocket of the bag and a nozzle 90 for an air jet blast which is connected to a source of air (not shown). The chute 82 is adapted for pivotal movement by a pneumatic cylinder 94 and is journaled to parallel side walls 100 at 92 and the gate 84 is adapted for pivotal movement at 96 by a pneumatic cylinder 98. The chute 82 and associated components are supported by the pair of parallel, spaced apart side walls 100 (only one shown).

Referring to FIG. 3, the vacuum arm 106 has engaged the back side 28 of the top most bag 22 of the wicket 20. At this time, the chute 82 is in a retracted upper position, the gate 86 is closed and the ram 66 and sealing bar 68 are also in their retracted positions.

Figure 4:
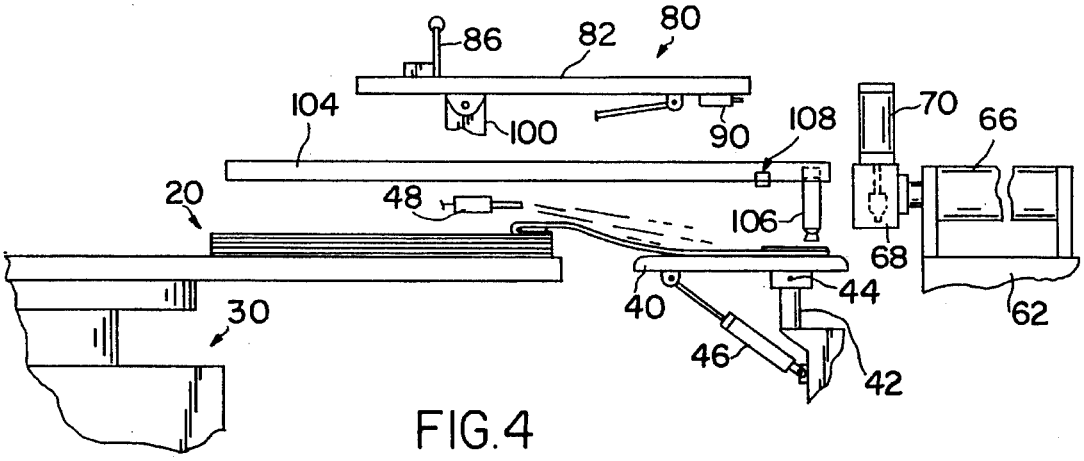
FIG. 4 is a side illustration of a bag transferred from a wicket to a feeding station.

Referring to FIG. 4, the bag has been transferred to the feeding station and lays on the plate 40. The plate 40 is journaled at 44 to a post 42 and is driven by a pneumatic piston 46 between a substantially horizontal position and a downwardly extending position where it defines an acute angle with the post 42. A nozzle 48 connected to a source of air (not shown) ensures that the bag as it travels from the platform 12 to the feeding station will lay flat on the plate. The arm 106 trips a microswitch 108 which stops the vacuum and actuates the nozzle 48 to deliver the air jet blast. Because the bag is being reversed from back side to front side, the air jet is needed to ensure that the bag does not stay at least partially engaged to the arm 106 and that it fully extends into the feeding station in a flat position.

Figure 5:
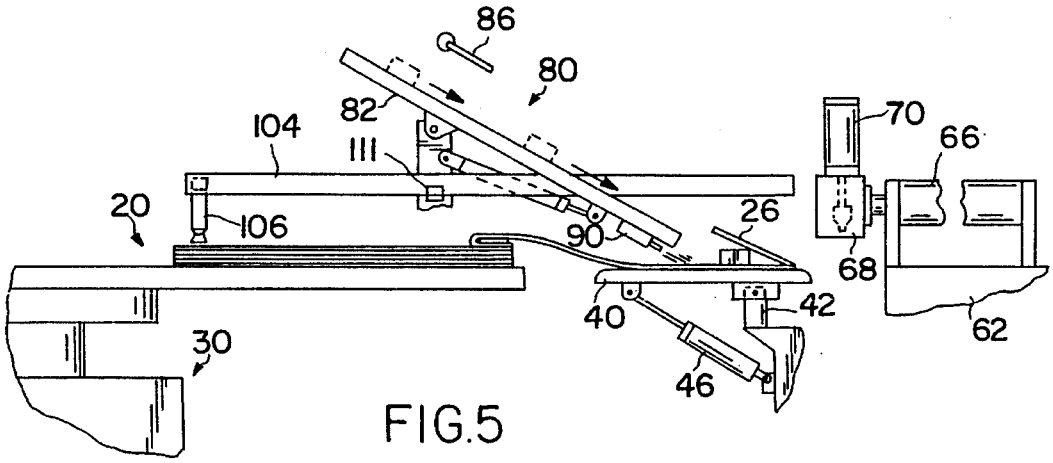
FIG. 5 is a side illustration of a pocket in a bag being opened and the introduction of a three-dimensional article into the pocket.
Figure 6:
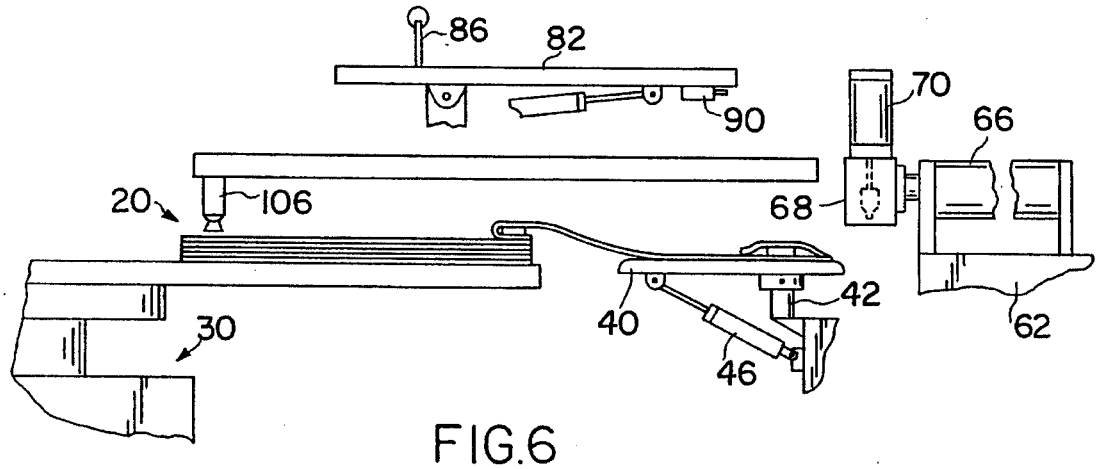
FIG. 6 is a side illustration of the retraction of a discharge chute.
Figure 7:
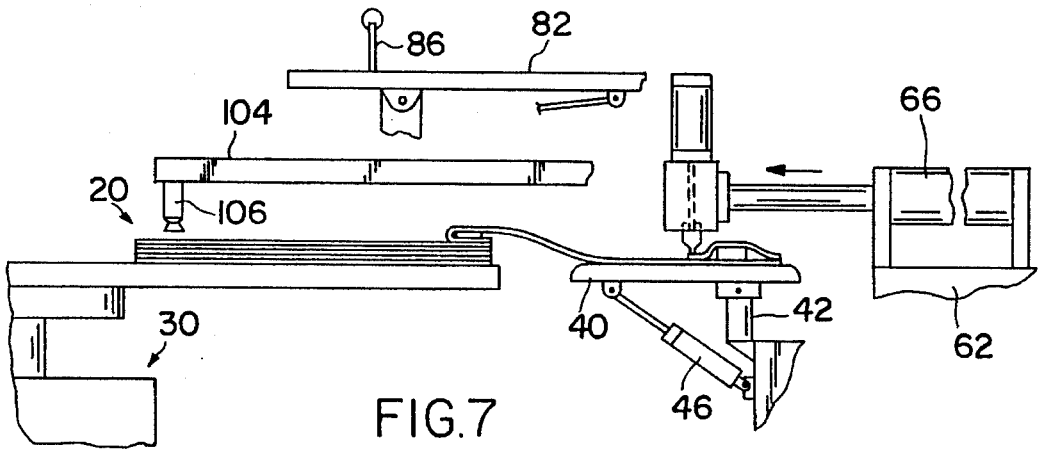
FIG. 7 is a side illustration of the sealing of the pocket to encapsulate the three-dimensional article therein.

Referring to FIGS. 5 and 9, the gate 86 moves to its open position allowing the article 88 to slide down the chute and the chute pivots between a substantially horizontal position and a downwardly extending position where the discharge end of the chute is in register with the pocket 26. The nozzle 90 discharges an air jet blast which billows the pocket 26 such that the article 88 may be received therein. In practice, the side edges of the pocket(s) 26 are sealed to the bag. In FIGS. 5, 6 and 7 this is not shown for clarity.

Referring to FIG. 6, the air jet from the nozzle 88 ceases, the chute moves to its original horizontal position and the gate moves to its closed position to restrain movement of the next article 88.

Referring to FIG. 7, the ram 60 extends outwardly, the sealing bar 68 moves downwardly engaging the free end of the pocket to seal the free edge of the pocket and to encapsulate the article 88 therein. This step seals the front side, back side and free edge of the pocket together along a seal line. When the bag is formed a release coat can be printed on the inside of the bag which will prevent the front and back side of the bags from sealing together.

Figure 8:
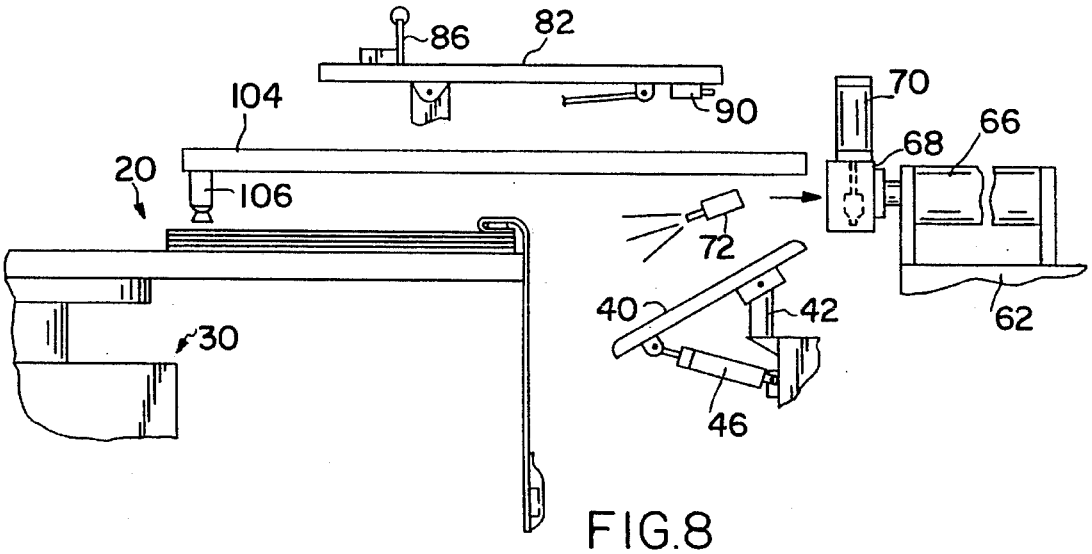
FIG. 8 is a side illustration of a bag after discharge from the feeding station.

Referring to FIG. 8, an air jet from a nozzle 72 contacts the front side of the bag. The retractable plate 40 moves to its downwardly extending position and the bag with the encapsulated article therein moves downwardly, still retained to the wicket.

Figure 10:
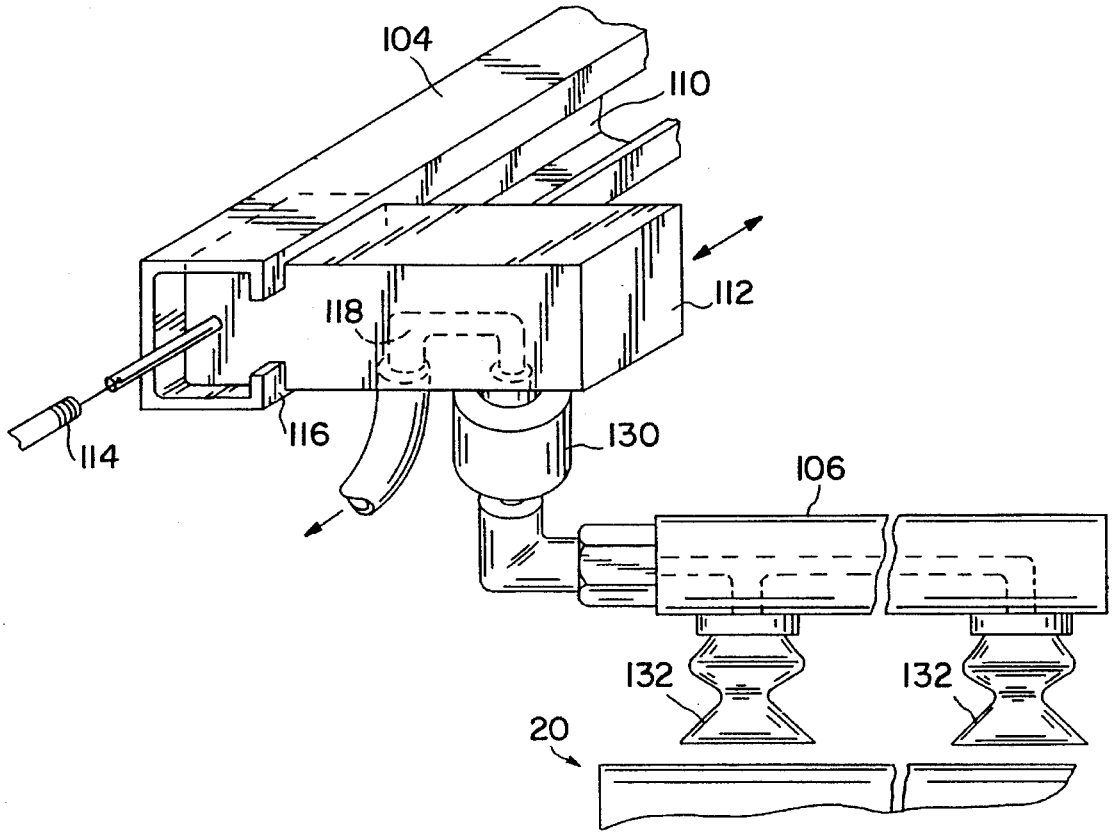
FIG. 10 is a perspective view of a vacuum acquisition arm.

Referring to FIG. 10, the track 104 is shown in greater detail and includes a U-shaped channel 110 in which is received a block 112. Secured to the rear of the block 112, as shown in the drawings, is a spring 114 which serves to return the block to its home position. Steps 116 formed in the channel 110 limit the rearward movement of the block. Received in the block is a vacuum line 118 which extends downwardly from the block and which line has a rotatable sleeve 130. The acquisition arm 106 is joined to the vacuum line through the rotatable sleeve. The acquisition arm 106 includes two paired depending suction cups 132 which engage the back side of the top most bag with the vacuum holding the bag against the suction cups while the acquisition arm travels from the home position to the feeding station.

Figure 11:
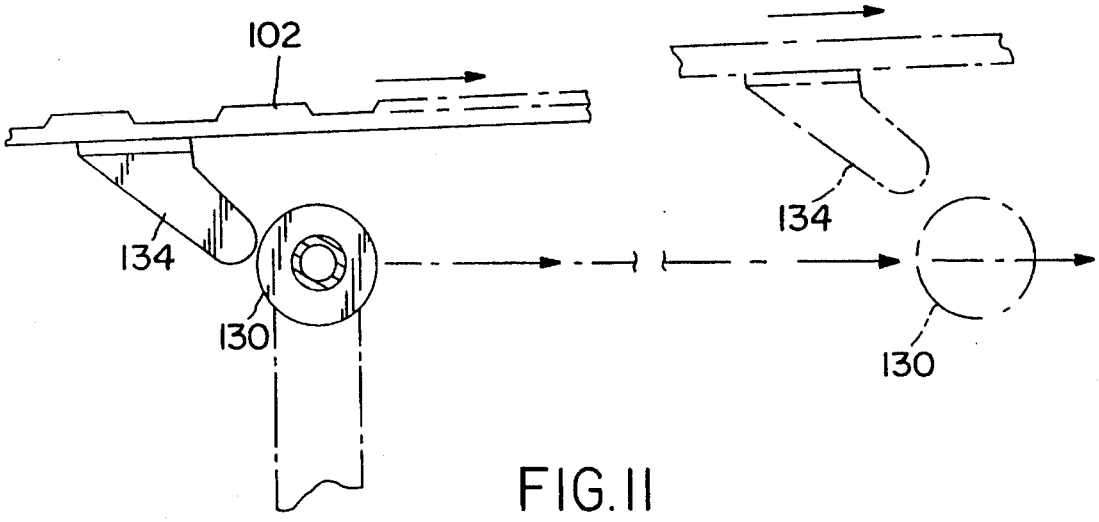
FIG. 11 is a plan view of a drive mechanism for the vacuum acquisition arm.

Referring to FIG. 11, the belt 102 which is a drive belt is carried on a drive reel, see FIG. 1, 120 which is pinned to a drive shaft 122. The drive motor joined to the drive shaft is not shown. The belt is also carried by an idle roller 124 which is pinned to an idle shaft 126 which is suitably journaled into a fixed support (not shown). The drive belt 102 includes two cams 134 spaced 180° apart. The movement of the drive belt is unidirectional. The cam 134 engages the collar 130 and carries the acquisition arm forward with the bag to the feeding station. With reference to the longitudinal axis which the acquisition arm travels, the belt is positioned in a non-parallel relationship such that the cam 134 and collar 130 of the acquisition arm 106 diverge away from one another as the acquisition arm approaches the feeding station. Ultimately, they diverge to such an extent that the cam 134 rides off the surface of the collar 130, and the acquisition arm 106 being biased to the home position returns down the track 106 until it engages the stops 116. Just prior to the cam 134 and collar disengaging, the microswitch 108 is actuated which breaks the vacuum being applied to the suction cups 132.

Figure 12:
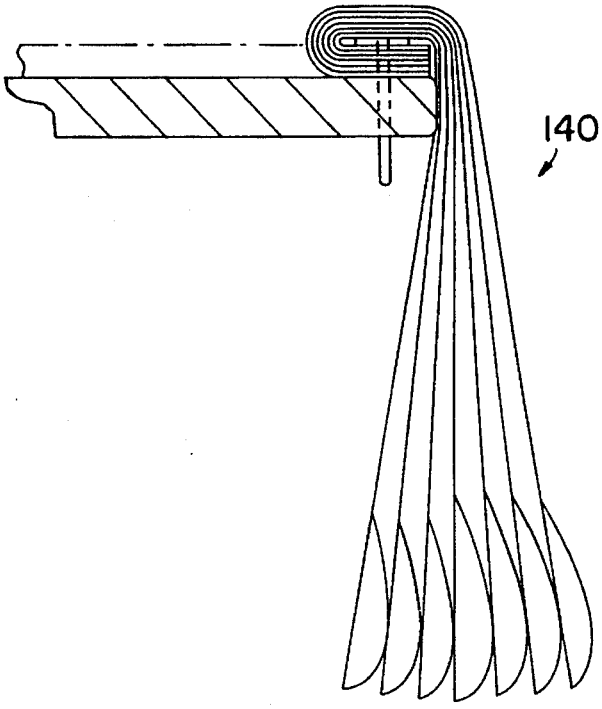
FIG. 12 is a side view of a wicket of bags.

Referring to FIG. 12, a wicket 140 of bags having articles encapsulated therein is shown at the unloading station 16.

OPERATION OF THE INVENTION

At initialization, the power, air and vacuum are all on. The ram 66 is back, the sealer bar 68 is up, the platform 12 is up, the chute 82 is up, the plate 40 is up and the drive motor in run condition.

The drive shaft 122 for the drive reel 124 is engaged and the cam 134 engages the roller 130 of the vacuum acquisition arm 106 which arm 106 has acquired the back side of the top most bag. The belt 102 moves the arm 106 and therefore the bag 22 to the plate 40. Just prior to the cam 128 releasing the acquisition arm 106, the acquisition arm actuates the microswitch 108 (FIG. 4) which breaks the vacuum between the bag 22 and the suction cups 132. At the same time, the timed air jet from the nozzle 48 assists in the movement of the bag to the plate 40 to ensure that the bag 22 lies flat. The vacuum acquisition arm 106 returns to home position by compression of the spring 114. A second microswitch 111 is actuated when the arm returns to the home position. When the second microswitch 110 is actuated, the platform 12 indexes upwardly and the vacuum is turned on. The chute 82 moves downwardly, by the action of the pneumatic cylinder 94 the gate 86 moves to its open position by the action of the associated pneumatic cylinder 98 and releases the sample 88 into the pocket 26 while an air jet blast from the nozzle 90 billows the pocket 26. The pneumatic cylinder 94 moves the chute to its raised horizontal position while the pneumatic cylinder 98 moves the gate 86 to its closed position. The ram 66 moves to its extended position, travelling over the pocket. The sealing bar 68 then moves downwardly, sealing the free edge of the pocket 26 to the bag. The seal bar 68 moves upwardly and the ram 66 retracts. The pneumatic cylinder 46 moves the plate 40 downwardly while the nozzle 72 provides an air jet to ensure that the bag with the encapsulated article is removed from the plate. The bag now hangs downwardly from the wicket such as shown in FIG. 12. The cycle then repeats. Any suitable controller to effect the sequence of steps, such as an Allen Bradley SLC 150 programmable controller may be used.

With the wicket of bags now having the articles encapsulated therein, the entire wicket can be removed for a subsequent step, such as filling the bag with a newspaper or removing the bag from the wicket.

The preferred invention has been described in reference to encapsulation of an article on one side of a bag in a wicket of bags. The system and method of the invention may also be used to fill either a pocket or a bag without sealing in which case the sealing apparatus would not be actuated. Alternatively, it may be used to fill a bag per se where the edge of the side of the bag facing upwardly at the feeding station is spaced apart from and lower than the edge of the back side of the bag such that the bag can be billowed to be filled. Further, sometimes it is discovered that there may be a misprinting on the bags of a wicket. To correct the misprinting, each bag with present prior art technology, either has to be overprinted by hand or the bags scraped. With this invention, such bags can be easily overprinted by a printing machine, such as a Markem, Model 236M. Thus, the bags need not be discarded. In this operation, obviously the nozzle on the underside of the chute is not used nor is the sealing apparatus.

The foregoing description has been limited to a specific embodiment of the invention. It will be apparent, however, that variations and modifications can be made to the invention, with the attainment of some or all of the advantages of the invention. Therefore, it is the object of the appended claims to cover all such variations and modifications as come within the true spirit and scope of the invention.

Having described my invention, what I now claim is:

1. A method of encapsulating an article within a pocket formed as an integral part of a bag, said bag being connected at a common header to a plurality of other bags to form a wicket, said pocket being bordered by a free edge defining an aperture communicating with the interior of said pocket, said method comprising the steps of:

locating said wicket at a first station with said common header positioned between said first station and an adjacent second station;

opening said aperture to gain access to the interior of the pocket;

inserting the article into the pocket through the thus opened aperture; and sealing the free edge to close said aperture and to encapsulate the article in the pocket;

said method additionally comprising a step of transferring said bag and its integral pocket across said common header from said first station to said second station at which the free edge is sealed, the aforesaid steps of opening, inserting, sealing and transferring being performed while the bag remains connected at said common header to said other bags.

2. The method as claimed in claim 1, wherein said bag is removed from said second station to a third station.

* * * * *